US010443872B2

(12) United States Patent
Yoon et al.

(10) Patent No.: US 10,443,872 B2
(45) Date of Patent: Oct. 15, 2019

(54) AIR CONDITIONER AND METHOD OF CONTROLLING THE SAME

(71) Applicant: LG ELECTRONICS INC., Seoul (KR)

(72) Inventors: Pilhyun Yoon, Seoul (KR); Yongcheol Sa, Seoul (KR); Chiwoo Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 738 days.

(21) Appl. No.: 14/850,739

(22) Filed: Sep. 10, 2015

(65) Prior Publication Data

US 2016/0131376 A1 May 12, 2016

(30) Foreign Application Priority Data

Nov. 12, 2014 (KR) ..... 10-2014-0156820

(51) Int. Cl.
*F25B 49/02* (2006.01)
*F24F 11/30* (2018.01)
(Continued)

(52) U.S. Cl.
CPC ..... *F24F 11/30* (2018.01); *F24F 11/70* (2018.01); *F24F 11/83* (2018.01); *F24F 11/41* (2018.01); *F24F 11/42* (2018.01); *F24F 2110/00* (2018.01); *F24F 2110/10* (2018.01); *F24F 2110/12* (2018.01); *F24F 2110/20* (2018.01); *F24F 2110/22* (2018.01);
(Continued)

(58) Field of Classification Search
CPC ..... F24F 11/30; F24F 11/31; F24B 49/02
See application file for complete search history.

(56) References Cited

U.S. PATENT DOCUMENTS 9,910,449 B2 3/2018 Matsuoka et al.
2002/0040280 A1* 4/2002 Morgan ..... B60H 1/00585 702/114
(Continued)

FOREIGN PATENT DOCUMENTS

DE 102013004252 A1 10/2014
EP 2157380 A1 2/2010
(Continued)

*Primary Examiner* — Ljiljana V. Ciric
*Assistant Examiner* — Alexis K Cox
(74) *Attorney, Agent, or Firm* — Dentons US LLP

(57) ABSTRACT

An air conditioner including an outside unit, which includes a compressor and an evaporator, an outside temperature sensor attached to the outside unit to sense outside temperature, an outside humidity recognition part attached to the outside unit to recognize information about outside humidity, a low pressure sensor that senses an evaporation pressure of the evaporator, and a control part that controls an operation of the compressor, based on both information about dew-point temperature sensed from the outside temperature sensor and the outside humidity recognition part and information about the evaporation pressure sensed from the low pressure sensor. The control part changes an operation frequency of the compressor according to whether the evaporation pressure is not lower than a preset reference low pressure, to prevent frosting of the evaporator.

10 Claims, 10 Drawing Sheets

(51) Int. Cl.

| | |
|---|---|
| ***F24F 11/70*** | (2018.01) |
| ***F24F 11/83*** | (2018.01) |
| *F24F 110/00* | (2018.01) |
| *F24F 110/10* | (2018.01) |
| *F24F 110/12* | (2018.01) |
| *F24F 110/20* | (2018.01) |
| *F24F 110/22* | (2018.01) |
| *F24F 110/40* | (2018.01) |
| *F24F 140/12* | (2018.01) |
| *F24F 11/41* | (2018.01) |
| *F24F 11/42* | (2018.01) |

(52) U.S. Cl.
CPC ..... *F24F 2110/40* (2018.01); *F24F 2140/12* (2018.01); *F25B 49/02* (2013.01); *F25B 49/022* (2013.01)

(56) References Cited

U.S. PATENT DOCUMENTS

2002/0121132 A1* 9/2002 Breed ..... B60C 11/24 73/146
2003/0017113 A1* 1/2003 Chen ..... A61K 9/0075 424/45
2004/0068390 A1* 4/2004 Saunders ..... F04B 49/065 702/182
2007/0006604 A1* 1/2007 Behr ..... A47F 3/0443 62/246
2007/0289318 A1* 12/2007 Nakamura ..... F25B 5/00 62/150
2010/0000243 A1* 1/2010 Morimoto ..... F24F 1/022 62/176.6
2011/0100041 A1* 5/2011 Crawford ..... F25B 13/00 62/156
2015/0260439 A1* 9/2015 Ohta ..... F25B 5/00 62/196.1
2015/0300706 A1* 10/2015 Awa ..... F25B 29/003 62/324.6
2015/0308462 A1* 10/2015 Awa ..... F04F 5/46 62/515
2017/0151856 A1* 6/2017 Kuwahara ..... B60H 1/00921

FOREIGN PATENT DOCUMENTS

JP 54-67252 A 5/1979
JP 09310927 A 12/1997
JP 2005-180835 7/2005
JP 2006-90567 A 4/2006
JP 2011-158219 A 8/2011

* cited by examiner

AIR CONDITIONER AND METHOD OF CONTROLLING THE SAME

CROSS-REFERENCE TO RELATED APPLICATIONS

The present application claims priority under 35 U.S.C. 119 and 35 U.S.C. 365 to Korean Patent Application No. 10-2014-0156820 (filed on Nov. 12, 2014), which is hereby incorporated by reference in its entirety.

BACKGROUND

The present disclosure relates to an air conditioner and a method of controlling the air conditioner.

Air conditioners optimally condition air in a predetermined space according to the uses and purposes thereof. Such an air conditioner includes a compressor, a condenser, an expansion device, and an evaporator, and performs a refrigerating cycle for compressing, condensing, expanding, and evaporating refrigerant, to thereby cool or heat the predetermined space.

The predetermined space may be variously changed according to areas where the air conditioner is used. For example, when the air conditioner is installed in a home or an office, the predetermined space may be an indoor space of a house or a building. When the air conditioner is installed in a vehicle, the predetermined space may be a passenger space.

When an air conditioner performs a cooling operation, an outdoor heat exchanger installed in an outdoor unit functions as a condenser, and an indoor heat exchanger installed in an indoor unit functions as an evaporator. On the contrary, when the air conditioner performs a heating operation, the indoor heat exchanger functions as a condenser, and the outdoor heat exchanger functions as an evaporator.

FIG. 1 is a block diagram illustrating a configuration of an air conditioner in the related art.

Referring to FIG. 1, an air conditioner 1 includes a set temperature input part 2 for inputting a set temperature of an indoor space, an indoor temperature sensor 3 that senses temperature of the indoor space, and a control part 7 that controls operations of a compressor 4, an outdoor fan 5, and an indoor fan 6, based on temperature information sensed by the set temperature input part 2 and the indoor temperature sensor 3.

The set temperature input part 2, the indoor temperature sensor 3, and the indoor fan 6 may be included in an indoor unit, and the compressor 4 and the outdoor fan 5 may be included in an outdoor unit.

For example, when a temperature value sensed at the indoor temperature sensor 3 is lower than a set temperature value input through the set temperature input part 2 during a heating operation of the air conditioner 1, the control part 7 may operate the compressor 4, the outdoor fan 5, and the indoor fan 6. The operation of the control part 7 may be performed until the temperature of the indoor space reaches the set temperature value.

When an air conditioner in the related art performs a heating operation, an outdoor heat exchanger, that is, an evaporator is frosted because of relatively low outdoor temperature. In detail, a surface temperature of the evaporator or the temperature of refrigerant flowing through the evaporator should be lower than the temperature of outdoor air for the evaporator to absorb heat from the outdoor air.

At this point, when the surface temperature of the evaporator decreases to be equal to or lower than dew-point temperature, condensate water is produced on an outer surface of the evaporator. When the surface temperature of the evaporator decreases to be equal to or lower than the freezing point, the condensate water is frozen to frost the outer surface of the evaporator.

A frost amount of the outer surface of the evaporator heavily depends on humidity of the outdoor air. That is, as the humidity of the outdoor air increases, the frost amount increases.

To defrost the evaporator, the air conditioner performs a defrosting operation, that is, a reverse cycle operation. At this point, the heating operation is restricted. Thus, as the number of times of performing the defrosting operation or a time period taken to perform the defrosting operation is increased, a heating performance is decreased. As a result, it is preferred to minimize the number of times of performing the defrosting operation and the time period taken to perform the defrosting operation.

However, such air conditioners in the related art just perform the defrosting operation according to a predetermined time interval and do not consider a humidity condition of outdoor air which may affect the frosting. As a result, the defrosting operation is uniformly performed regardless of whether outdoor humidity is high or low, which jeopardizes optimization of defrosting efficiency and heating efficiency.

SUMMARY

Embodiments provide an air conditioner adapted for preventing frosting and improving heating performance, and a method of controlling the air conditioner.

In one embodiment, an air conditioner includes: an outdoor unit, which is provided with a compressor and an evaporator; an outdoor temperature sensor installed on the outdoor unit to sense outdoor temperature; an outdoor humidity recognition part installed on the outdoor unit to recognize information about outdoor humidity; a low pressure sensor that senses an evaporation pressure of the evaporator; and a control part that controls an operation of the compressor, based on both information about dew-point temperature sensed from the outdoor temperature sensor and the outdoor humidity recognition part and information about the evaporation pressure sensed from the low pressure sensor, wherein the control part changes an operation frequency of the compressor according to whether the evaporation pressure is not lower than a preset reference low pressure, to prevent frosting of the evaporator.

The air conditioner may further include a memory part that stores mapping information for changing the operation frequency of the compressor according to values sensed at the outdoor temperature sensor, the outdoor humidity recognition part, and the low pressure sensor.

The memory part may store information about the preset reference low pressure, and the preset reference low pressure may include a third reference low pressure used to determine whether to start or stop a changing mode for the operation frequency of the compressor.

The preset reference low pressure may include a first reference low pressure used to determine whether to decrease the operation frequency of the compressor in the changing mode for the operation frequency of the compressor.

When the evaporation pressure is lower than the first reference low pressure, the control part may control the compressor such that the operation frequency of the compressor is decreased by a value corresponding to a first set pressure.

The preset reference low pressure may include a second reference low pressure used to determine whether to increase the operation frequency of the compressor in the changing mode for the operation frequency of the compressor.

When the evaporation pressure is equal to or higher than the first reference low pressure and is equal to or lower than the second reference low pressure, the control part may control the compressor to maintain the operation frequency of the compressor.

When the evaporation pressure is higher than the second reference low pressure and is lower than the third reference low pressure, the control part may control the compressor to increase the operation frequency of the compressor.

When the evaporation pressure is equal to or higher than the third reference low pressure, the control part may stop the changing mode for the operation frequency of the compressor.

The outdoor humidity recognition part may include an outdoor humidity sensor.

The memory part may further store information obtained by mapping increase rate values of an operation frequency of the compressor according to the information about the outdoor humidity.

When it is recognized that the outdoor humidity is lower than a first set outdoor humidity (h01), the control part may control an increase rate of the operation frequency to be maintained at a first set operation frequency rate (V1) until arriving at a set frequency after activation of the compressor; when it is recognized that the outdoor humidity is higher than a second set outdoor humidity (h02), the control part may control the increase rate of the operation frequency to be maintained at a second set operation frequency rate (V2) until arriving at a set frequency after the activation of the compressor; and the second set outdoor humidity (h02) may be higher than the first set outdoor humidity (h01), and the first set operation frequency rate (V1) may be higher than the second set operation frequency rate (V2).

When it is recognized that the outdoor humidity is equal to or higher than the first set outdoor humidity (h01) and is equal to or lower than the second set outdoor humidity (h02), the control part may control the increase rate of the operation frequency to be decreased according to an increase of the outdoor humidity.

The outdoor humidity recognition part may include a communication part that receives the information about the outdoor humidity from a server.

In another embodiment, a method of controlling an air conditioner includes: inputting an operation command for the air conditioner through which a refrigerating cycle circulates; recognizing both information about outdoor temperature and outdoor humidity of an outdoor space and information about a low pressure of the refrigerating cycle; determining whether to perform a changing mode in which a target high pressure of the refrigerating cycle is changed, according to whether the low pressure of the refrigerating cycle is higher than a reference low pressure; and changing an operation frequency of a compressor according to a range of the low pressure of the refrigerating cycle when the changing mode is performed.

When it is recognized that the low pressure of the refrigerating cycle is higher than the reference low pressure, a normal mode in which the target high pressure of the refrigerating cycle is maintained to remain steady may be performed; and when it is recognized that the low pressure of the refrigerating cycle is lower than the reference low pressure, the changing mode may be performed.

When the low pressure of the refrigerating cycle is lower than a first reference low pressure lower than the reference low pressure, the operation frequency of the compressor may be decreased to decrease the target high pressure of the refrigerating cycle.

When the low pressure of the refrigerating cycle is higher than a second reference low pressure higher than the first reference low pressure, the operation frequency of the compressor may be increased to increase the target high pressure of the refrigerating cycle.

The operation frequency of the compressor may be controlled based on information mapped to decrease an increase rate of the operation frequency of the compressor as the outdoor humidity increases.

When it is recognized that the outdoor humidity is lower than a first set outdoor humidity (h01), the increase rate of the operation frequency may be controlled to be maintained at a first set operation frequency rate (V1) until arriving at a set frequency after activation of the compressor; when it is recognized that the outdoor humidity is higher than a second set outdoor humidity (h02), the increase rate of the operation frequency may be controlled to be maintained at a second set operation frequency rate (V2) until arriving at a set frequency after the activation of the compressor; and when it is recognized that the outdoor humidity is equal to or higher than the first set outdoor humidity (h01) and is equal to or lower than the second set outdoor humidity (h02), the increase rate of the operation frequency may be controlled to be decreased according to the increase of the outdoor humidity.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to embodiments of the present disclosure, examples of which are illustrated in the accompanying drawings.

Figure 1:
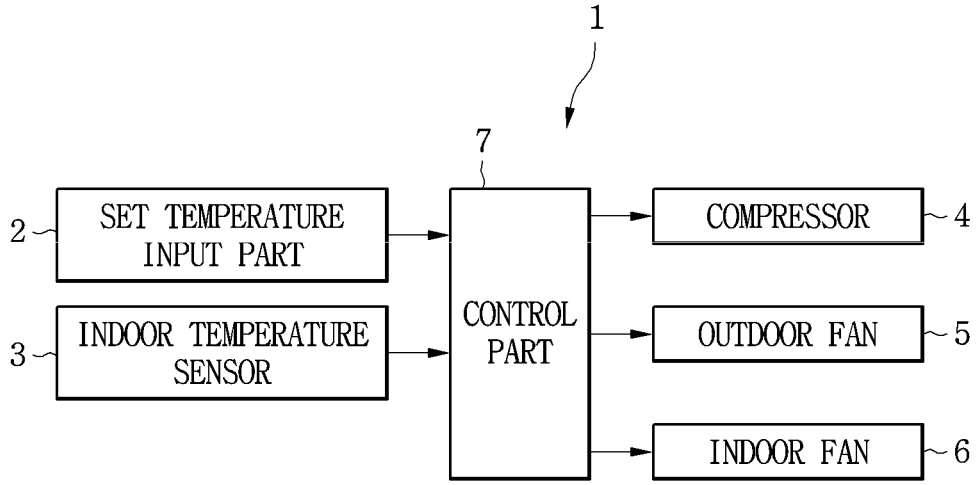
FIG. 1 is a block diagram illustrating a configuration of an air conditioner in the related art.
Figure 2:
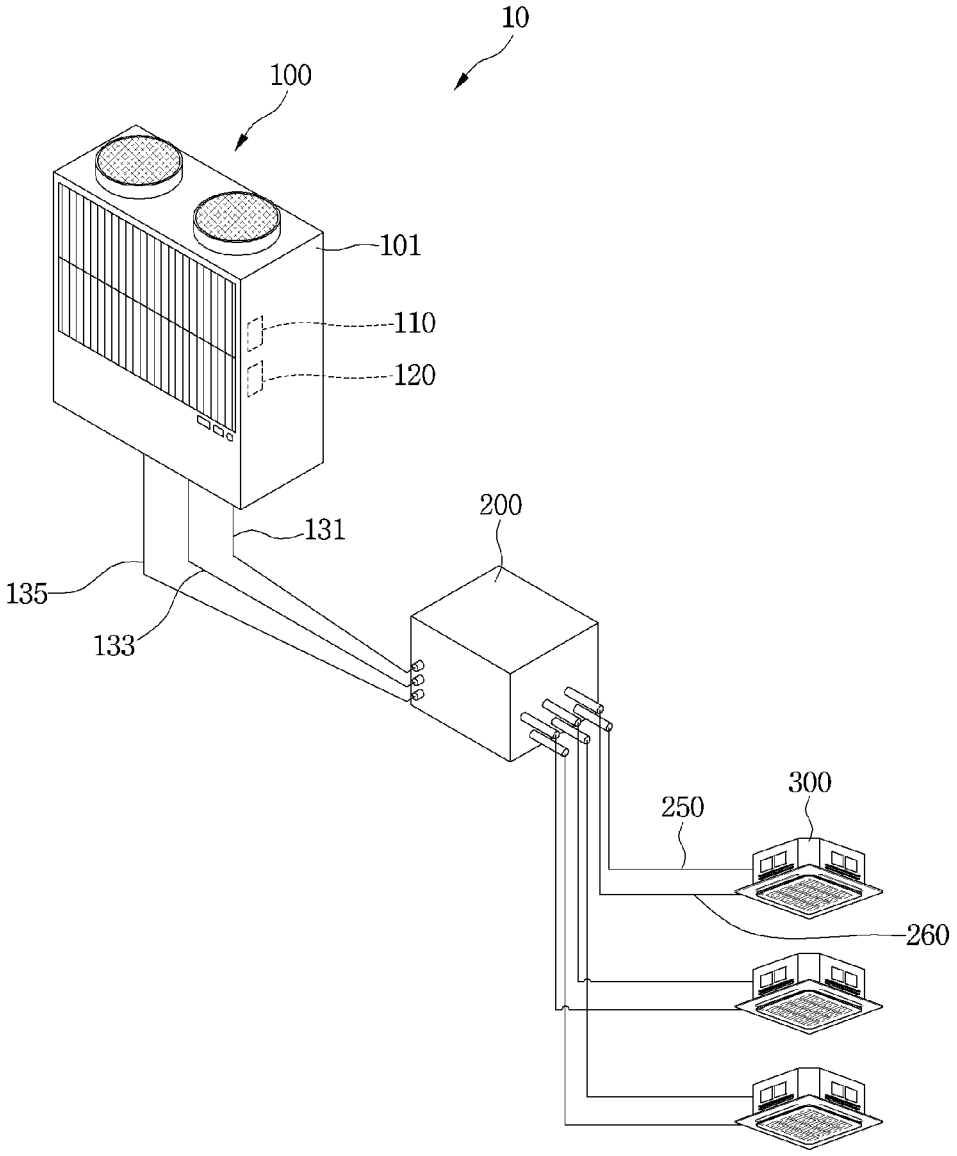
FIG. 2 is a view illustrating a configuration of an air conditioner according to an embodiment of the invention.
Figure 3:
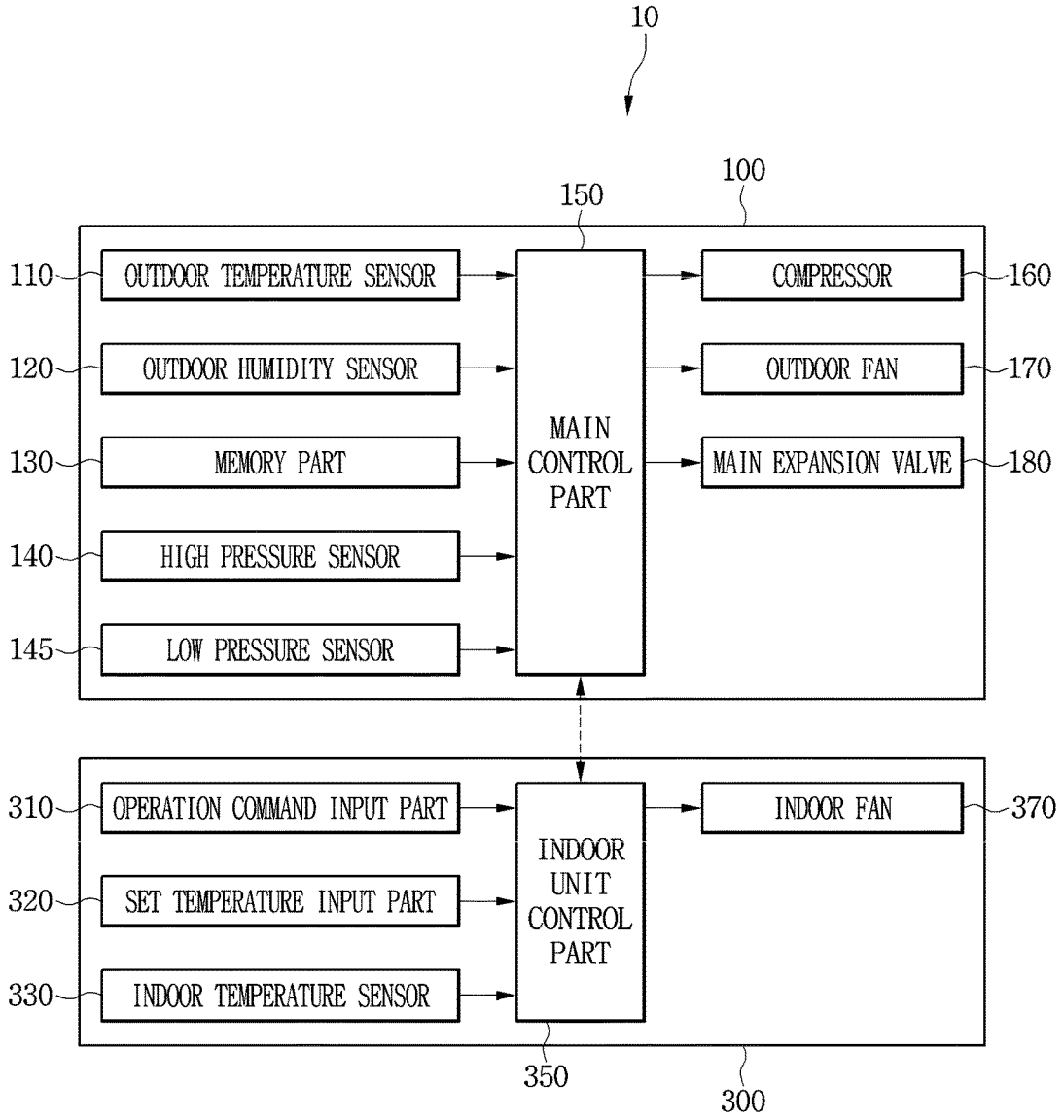
FIG. 3 is a block diagram illustrating the configuration of the air conditioner according to the embodiment of FIG. 2.

FIG. 2 is a view illustrating a configuration of an air conditioner according to an embodiment. FIG. 3 is a block diagram illustrating the configuration of the air conditioner according to the embodiment of FIG. 2.

Referring to FIG. 2, an air conditioner 10 according to the current embodiment includes an outdoor unit 100, a distributing unit 200, and a plurality of indoor units 300.

In detail, the air conditioner 10 includes three pipe arrangements 131, 133, and 135 which connect the outdoor unit 100 to the distributing unit 200. The pipe arrangements 131, 133, and 135 include a first connecting pipe arrangement 131, a second connecting pipe arrangement 133, and a third connecting pipe arrangement 135.

The air conditioner 10 includes a plurality of distributing pipe arrangements 250 and 260 which connect the distributing unit 200 to the indoor units 300. The distributing pipe arrangements 250 and 260 may include an inflow pipe arrangement 250 that guides an inflow of refrigerant to one of the indoor units 300, and an outflow pipe arrangement 260 that guides an outflow of the refrigerant from the indoor unit 300. The inflow pipe arrangement 250 and the outflow pipe arrangement 260 may be provided to correspond to each of the indoor units 300.

The outdoor unit 100 includes a case 101 forming an appearance thereof and equipped with a plurality of elements, and an outdoor temperature sensor 110 and an outdoor humidity sensor 120, which are installed at a side of the case 101.

The elements includes a compressor 160 that compresses the refrigerant, an outdoor fan 170 that moves outdoor air to an outdoor heat exchanger (not shown), and a main expansion valve 180 for depressurizing the refrigerant. The outdoor temperature sensor 110 is installed in the case 101 to sense outdoor temperature, and the outdoor humidity sensor 120 is installed in the case 101 to sense outdoor humidity.

The compressor 160 may include an inverter compressor for changing an operation frequency.

The outdoor unit 100 includes a memory part 130 that stores information mapped based on values sensed by the outdoor temperature sensor 110 and the outdoor humidity sensor 120.

The mapped information includes information about dew-point temperature determined according to outdoor temperature and outdoor humidity. That is, the memory part 130 may store information about a psychrometric chart to determine the dew-point temperature based on the outdoor temperature and the outdoor humidity.

The mapped information may include information for determining whether to change a target high pressure according to whether a low pressure sensed at a refrigerating cycle is higher or lower than a reference pressure, and information for adjusting an operation frequency of a compressor to change the target high pressure. The target high pressure is a high pressure as a reference for controlling a pressure of the refrigerating cycle, that is, a target condensing pressure.

The target high pressure may be changed by adjusting the operation frequency of the compressor. For example, the operation frequency of the compressor may be increased to increase the target high pressure. When the operation frequency of the compressor is increased, a low pressure of the refrigerating cycle may be decreased. On the contrary, the operation frequency of the compressor may be decreased to decrease the target high pressure. When the operation frequency of the compressor is decreased, the low pressure of the refrigerating cycle may be increased.

The outdoor unit 100 further includes a high pressure sensor 140 for sensing a high pressure of the refrigerating cycle, that is, a condensing pressure, and a low pressure sensor 145 for sensing the low pressure of the refrigerating cycle, that is, an evaporation pressure. The high pressure sensor 140 may be installed at an outlet side of the compressor 160, and the low pressure sensor 145 may be installed at an inlet side of the compressor 160.

The outdoor unit 100 further includes a main control part 150, which uses information stored in the memory part 130 and values sensed, respectively, by sensors 110, 1201, 40, and 145, to control operations of the compressor 160, the outdoor fan 170, and the main expansion valve 180.

The indoor units 300 include an operation command input part 310 on which an input operation can be performed to start operations of the indoor units 300, a set temperature input part 320 for inputting a desired temperature for an indoor space, and an indoor temperature sensor 330 for sensing a temperature of the indoor space.

The indoor units 300 further include an indoor unit control part 350, which controls an operation of an indoor fan 370, based on information input or recognized from the operation command input part 310, the set temperature input part 320, and the indoor temperature sensor 330.

The main control part 150 may be connected to the indoor unit control part 350 such that the main control part 150 can communicate with the indoor unit control part 350. A combination of the main control part 150 and the indoor unit control part 350 may be referred to as "a control part".

Figure 4:
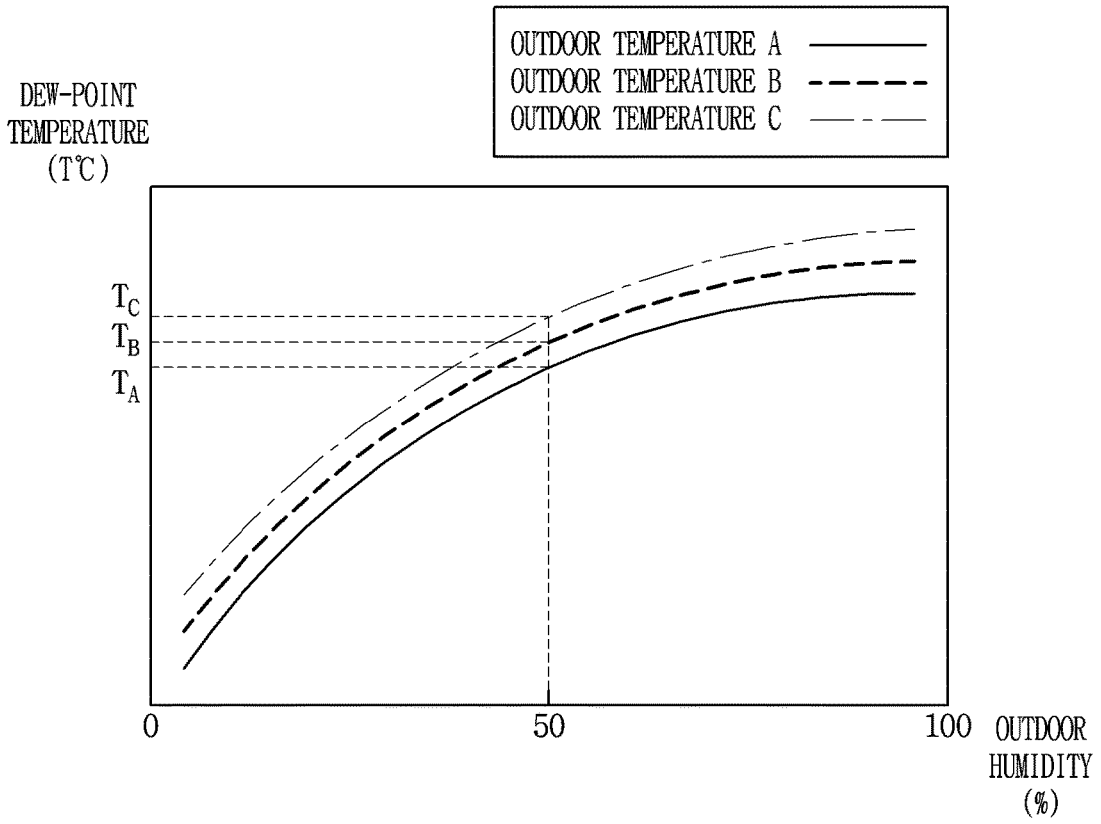
FIG. 4 is a graph illustrating dew-point temperature increasing, corresponding to an increase in outdoor humidity, according to outdoor temperatures.
Figure 5:
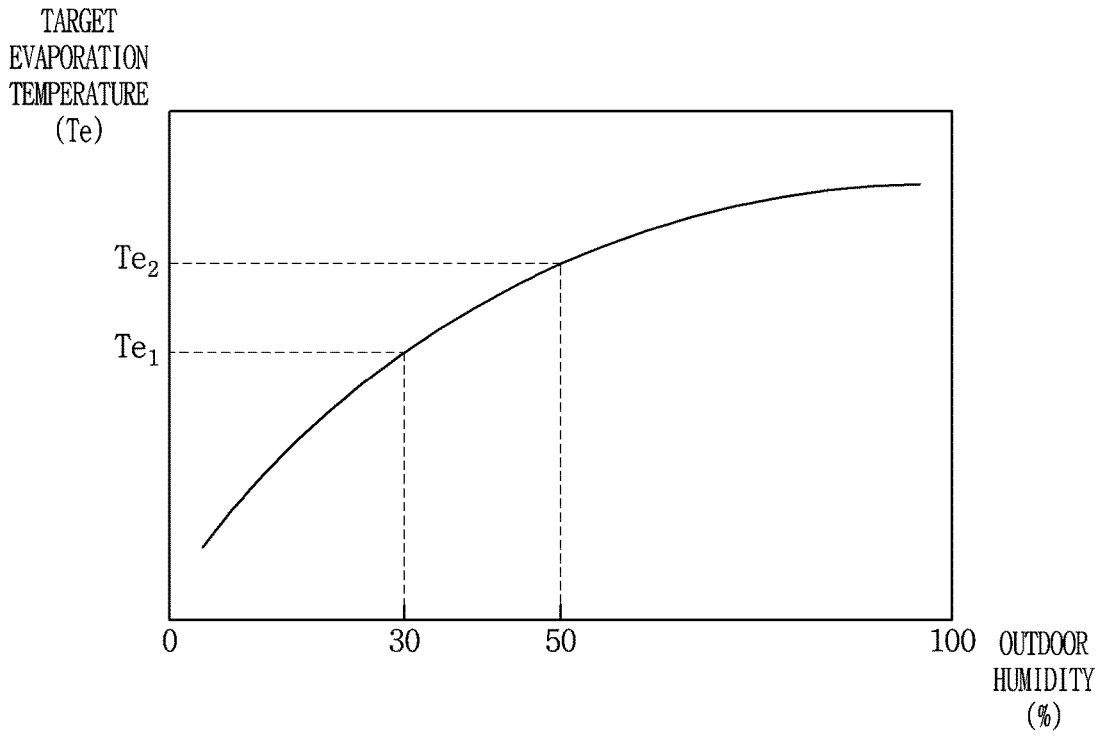
FIG. 5 is a graph showing a process of controlling the air conditioner in which an evaporation pressure (a low pressure) is increased according to the increase in the outdoor humidity, according to the embodiment of FIG. 2.

FIG. 4 is a graph showing dew-point temperature increasing, corresponding to an increase in outdoor humidity, according to outdoor temperatures. FIG. 5 is a graph showing a process of controlling the air conditioner in which an evaporation pressure (a low pressure) is increased according to the increase in the outdoor humidity, according to the current embodiment.

Referring to FIG. 4, the dew-point temperature changes corresponding to a variation in the outdoor humidity. In detail, the dew-point temperature increases at a predetermined rate of change as the outdoor humidity increases at a specific outdoor temperature.

That is, as the outdoor humidity increases, the dew-point temperature increases. Thus, when a surface temperature of an evaporator, that is, an evaporation temperature decreases during a heating operation of an air conditioner, and outdoor humidity is high, a greater amount of condensate water may be produced more quickly. The produced condensate water may frost an outer surface of the evaporator according to outdoor temperature.

As the outdoor temperature increases, the dew-point temperature increases. Outdoor temperatures A, B, and C shown in FIG. 4 satisfy a relationship of A<B<C. When a specific outdoor humidity is, e.g., an outdoor humidity of 50%, the outdoor temperatures A, B, and C correspond to dew-point temperatures TA, TB, and TC, respectively. The dew-point temperatures TA, TB, and TC satisfy a relationship of TA<TB<TC.

According to a relationship between the outdoor humidity and the dew-point temperature as illustrated in FIG. 4, the air conditioner 10 is controlled to increase the evaporation pressure of the refrigerating cycle, that is, the low pressure according to the increase in the outdoor humidity. That is, the memory part 130 stores mapping information of target low pressures according to the outdoor humidity.

In detail, referring to FIG. 5, target evaporation temperatures Te mapped onto the outdoor humidity may be determined to be increase as the outdoor humidity increases. For example, a second target evaporation temperature Te2 mapped onto an outdoor humidity of 50% may be determined to be higher than a first target evaporation temperature Te1 mapped onto an outdoor humidity of 30%.

To sum up, as the outdoor humidity increases, the dew-point temperature increases, thus increasing the possibility of production of condensate water and frosting even at a relatively high evaporation temperature. To address this issue, the air conditioner 10 may be controlled to increase a target evaporation temperature of the refrigerating cycle.

The increase of the target evaporation temperature may be understood as an increase of the low pressure of the refrigerating cycle, that is, an increase of the evaporation pressure. The operation frequency of the compressor 160 may be decreased to increase the target evaporation temperature.

Figure 6:
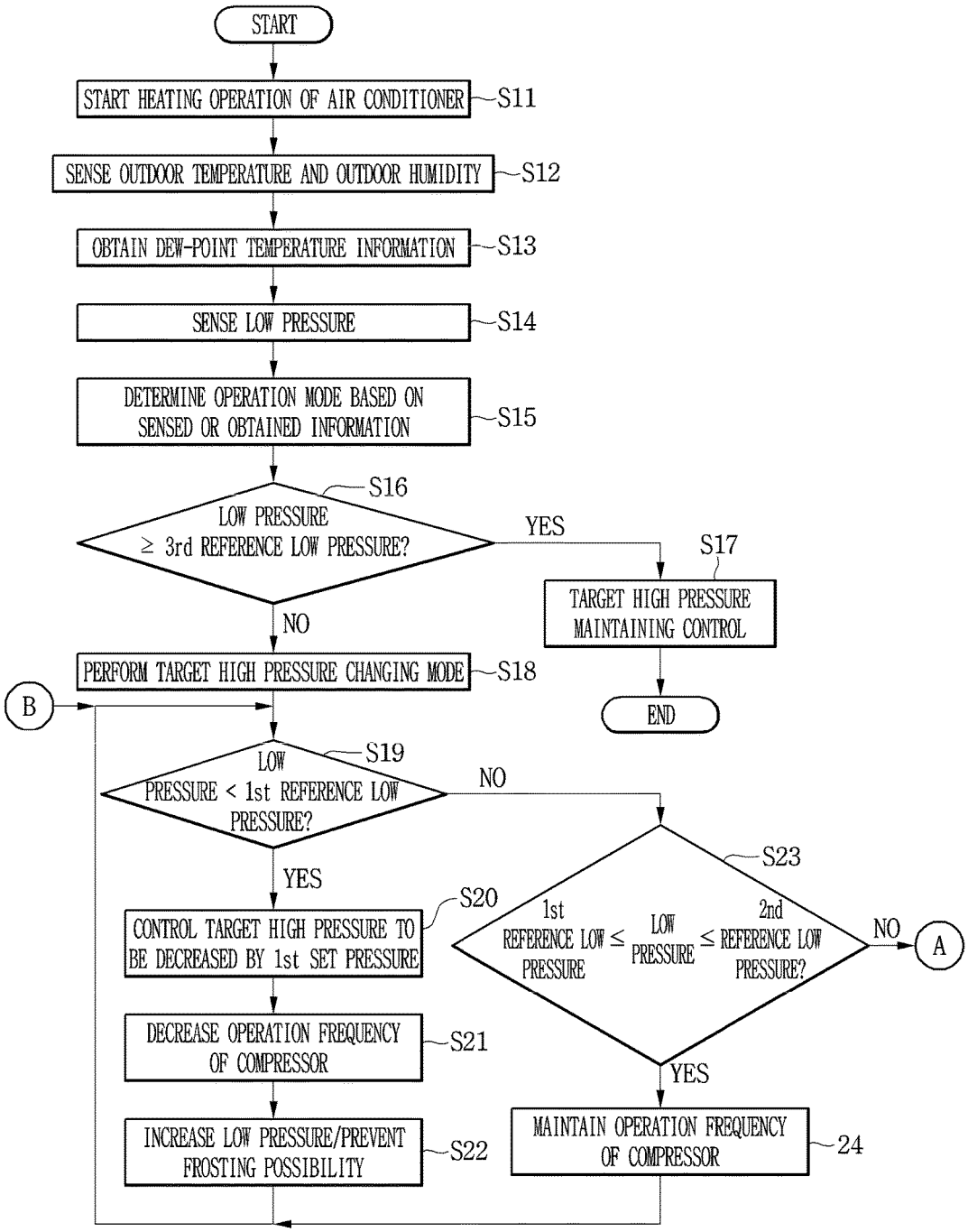
FIGS. 6 and 7 are flowcharts illustrating a method of controlling an air conditioner according to an embodiment of the invention.
Figure 7:
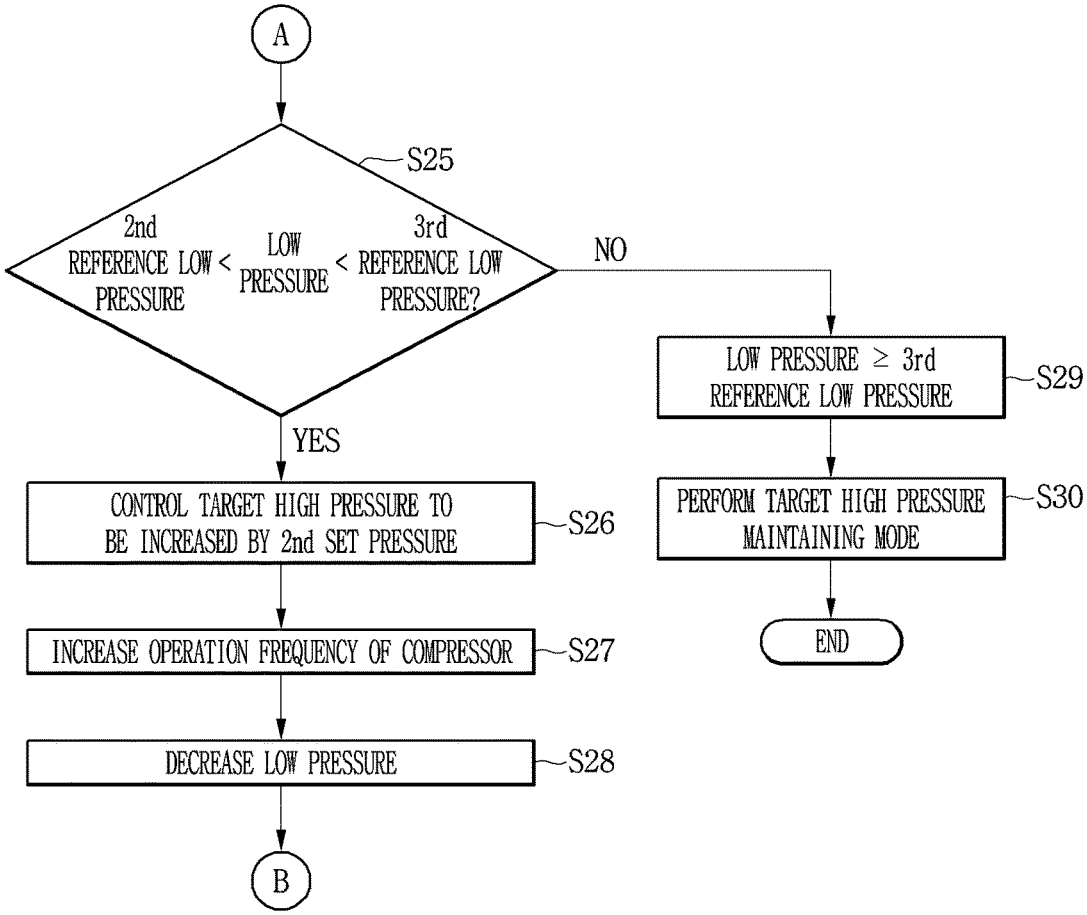

FIGS. 6 and 7 are flowcharts illustrating a method of controlling an air conditioner according to an embodiment. Referring to FIGS. 6 and 7, a method of controlling an air conditioner will now be described according to the current embodiment.

When an operation command for the air conditioner 10 is input to start a heating operation of the air conditioner 10, outdoor temperature and outdoor humidity are sensed through the outdoor temperature sensor 110 and the outdoor humidity sensor 120. Information about dew-point temperature may be obtained based on the sensed outdoor temperature and outdoor humidity (operations S11, S12, and S13).

A current low pressure of the refrigerating cycle is sensed using the low pressure sensor 145. An operation mode of the air conditioner 10 may be determined based on the sensed current low pressure or the obtained information. In detail, the operation mode of the air conditioner 10 may be determined based on the sensed outdoor temperature, the obtained information of the dew-point temperature, or information about the sensed current low pressure (operations S14 and S15).

It may be recognized whether the current low pressure of the refrigerating cycle is not lower than a third reference low pressure (operation S16). When the current low pressure of the refrigerating cycle is not lower than the third reference low pressure, the target high pressure of the refrigerating cycle may be controlled to be maintained in a set range. That is, the operation frequency of the compressor 160 may be maintained in a set range or at a set value to maintain the target high pressure. The third reference low pressure is a value determined based on the current low pressure and the outdoor humidity (or the information of the dew-point temperature) and may be an input value that denotes a relatively high low pressure. The third reference low pressure is stored in the memory part 130.

To sum up, when the current low pressure of the refrigerating cycle is higher than the third reference low pressure, it may be recognized that an evaporation temperature has a value equal to or higher than the dew-point temperature. Accordingly, it may be recognized that the possibility of production of condensate water and frosting is low to a certain degree. Thus, in this state, a control operation may be performed in "a target high pressure maintaining mode" or "a normal mode", without changing and controlling a separate target high pressure (operation S17).

When the current low pressure of the refrigerating cycle is lower than the third reference low pressure in operation S16, a control operation for changing the target high pressure of the refrigerating cycle, that is, a control operation may be performed in "a target high pressure changing mode" (operation S18).

While the control operation may be performed in the target high pressure changing mode, it is recognized whether the current low pressure sensed by the low pressure sensor 145 is lower than a first reference low pressure (operation S19). The first reference low pressure is a value determined based on the current low pressure and the outdoor humidity (or the information of the dew-point temperature) and may be an input value that denotes a relatively low pressure. In addition, the first reference low pressure may be an input value lower than the third reference low pressure. The first reference low pressure is stored in the memory part 130.

When the current low pressure of the refrigerating cycle is lower than the first reference low pressure, the target high pressure of the refrigerating cycle may be controlled to be lowered by a first set pressure. The operation frequency of the compressor 160 may be decreased by a set frequency in order to decrease the target high pressure. The set frequency may be a frequency corresponding to the first set pressure.

While the target high pressure is decreased by decreasing the operation frequency of the compressor 160, a current high pressure may be monitored through the high pressure sensor 140, and a control operation for decreasing the operation frequency of the compressor 160 may be maintained until the current high pressure reaches the decreased target high pressure.

When the operation frequency of the compressor 160 is decreased, the current low pressure of the refrigerating cycle increases. After a control operation for decreasing the target high pressure, operation S19 is performed again to re-recognize whether the current low pressure is lower than the first reference low pressure. When the current low pressure is lower than the first reference low pressure, operations S20 to S22 may be performed again. This process may be repeated.

To sum up, when the current low pressure of the refrigerating cycle is lower than the first reference low pressure, it may be recognized that the evaporation temperature has a value equal to or lower than the dew-point temperature and is equal to or lower than the freezing point. Accordingly, it may be recognized that the possibility of production of condensate water and frosting is high to a certain degree. Thus, in this state, the operation frequency of the compressor 160 is decreased to decrease the target high pressure. Accordingly, a control operation may be performed to induce the increasing of the current low pressure (operations S20, S21, and S22).

When the current low pressure sensed by the low pressure sensor 145 is equal to or higher than the first reference low pressure in operation S19, it is recognized whether the current low pressure is not higher than a second reference low pressure (operation S23). The second reference low pressure is a value determined based on the current low pressure and the outdoor humidity (or the information of the dew-point temperature) and may be an input value that denotes a medium low pressure. In addition, the second reference low pressure may be an input value higher than the first reference low pressure and lower than the third reference low pressure. The second reference low pressure is stored in the memory part 130.

When the current low pressure is equal to or higher than the first reference low pressure and is equal to or lower than the second reference low pressure, the operation frequency of the compressor 160 is maintained. That is, when the current low pressure is equal to or higher than the first reference low pressure and is equal to or lower than the second reference low pressure, although the current low pressure is not high enough to perform the normal mode as in operation S17, it may be recognized that the target high pressure is formed within an appropriate range in "the target high pressure changing mode". Thus, the operation frequency of the compressor 160 may be maintained in order to maintain the target high pressure without changing the target high pressure (operation S24).

After operation S24, the method may be repeated from operation S19 until the current low pressure is out of the range equal to or higher than the first reference low pressure and equal to or lower than the second reference low pressure.

When the current low pressure is higher than the second reference low pressure in operation S23, it is recognized whether the current low pressure is not higher than the third reference low pressure (operation S25).

When the current low pressure is higher than the second reference low pressure and is lower than the third reference low pressure, it may be recognized that a sufficient high pressure for maintaining a heating performance is not formed. Thus, a control operation for increasing the target high pressure of the refrigerating cycle by a second set pressure may be performed. The operation frequency of the compressor 160 may be increased by a set frequency in order to increase the target high pressure. The set frequency may be a frequency corresponding to the second set pressure.

While the target high pressure is increased by increasing the operation frequency of the compressor 160, the current high pressure may be monitored through the high pressure sensor 140, and a control operation for increasing the operation frequency of the compressor 160 may be maintained until the current high pressure reaches the increased target high pressure.

When the operation frequency of the compressor 160 is increased, the current low pressure of the refrigerating cycle decreases. After the control operation for increasing the target high pressure, operations S19, S23, and S25 may be performed again to re-recognize a range of the current low pressure. Then, the method may be performed according to the re-recognized range of the current low pressure.

When the current low pressure is equal to or higher than the third reference low pressure in operation S25, it is recognized that the current low pressure is sufficiently high, and thus, "the target high pressure maintaining mode" may be performed (operations S29 and S30).

As such, whether the current low pressure is lower than the third reference low pressure may be whether "the target high pressure changing mode", that is, a compressor operation frequency changing mode may be performed or stopped. That is, when the current low pressure is lower than the third reference low pressure, the target high pressure changing mode may be performed; and when the current low pressure is not lower than the third reference low pressure, the target high pressure maintaining mode may be performed.

Whether the current low pressure is lower than the first reference low pressure and whether the current low pressure is out of the range equal to or higher than the first reference low pressure and equal to or lower than the second reference low pressure may be conditional information for determining whether the operation frequency of the compressor 160 is increased or decreased in "the target high pressure changing mode", that is, in the compressor operation frequency changing mode.

Figure 8:
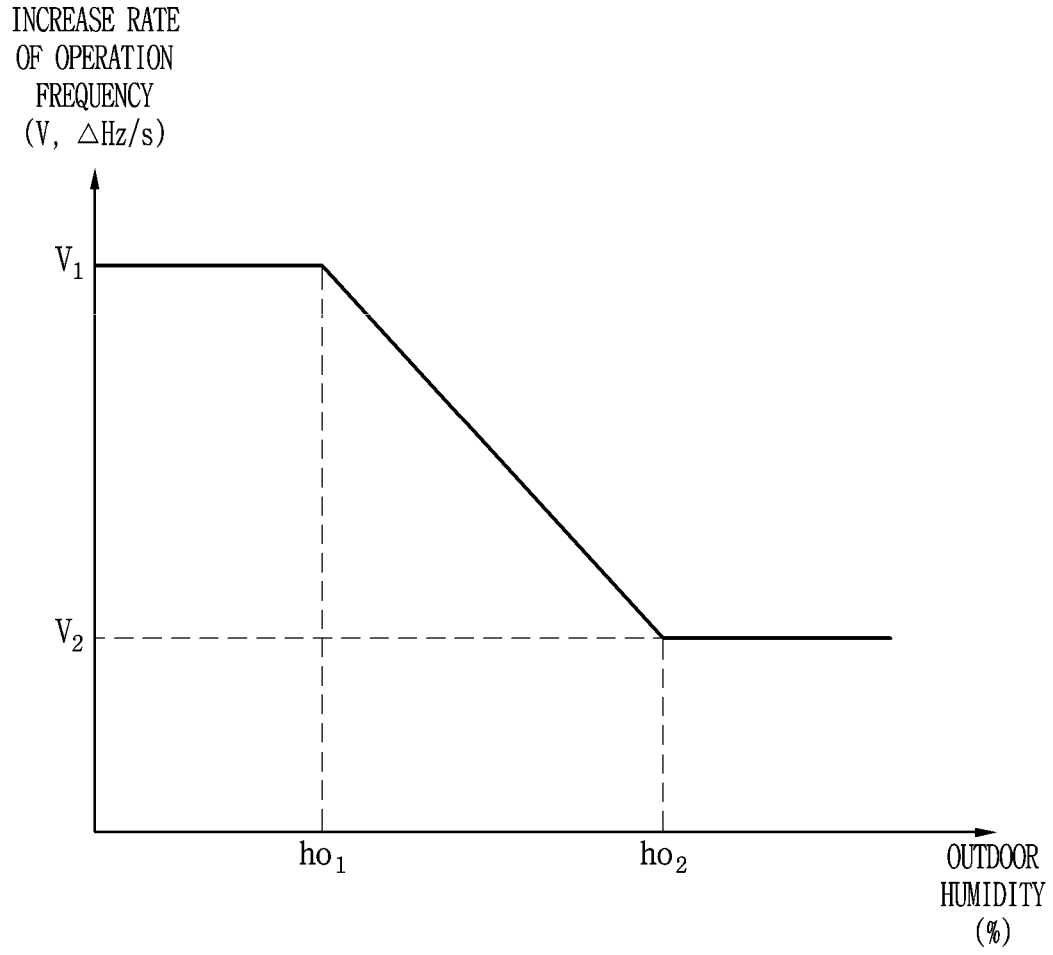
FIG. 8 is a graph showing a process of controlling the air conditioner in which an increase rate of an operation frequency of a compressor is decreased according to the increase in the outdoor humidity, according to the embodiment of FIG. 2.
Figure 9:
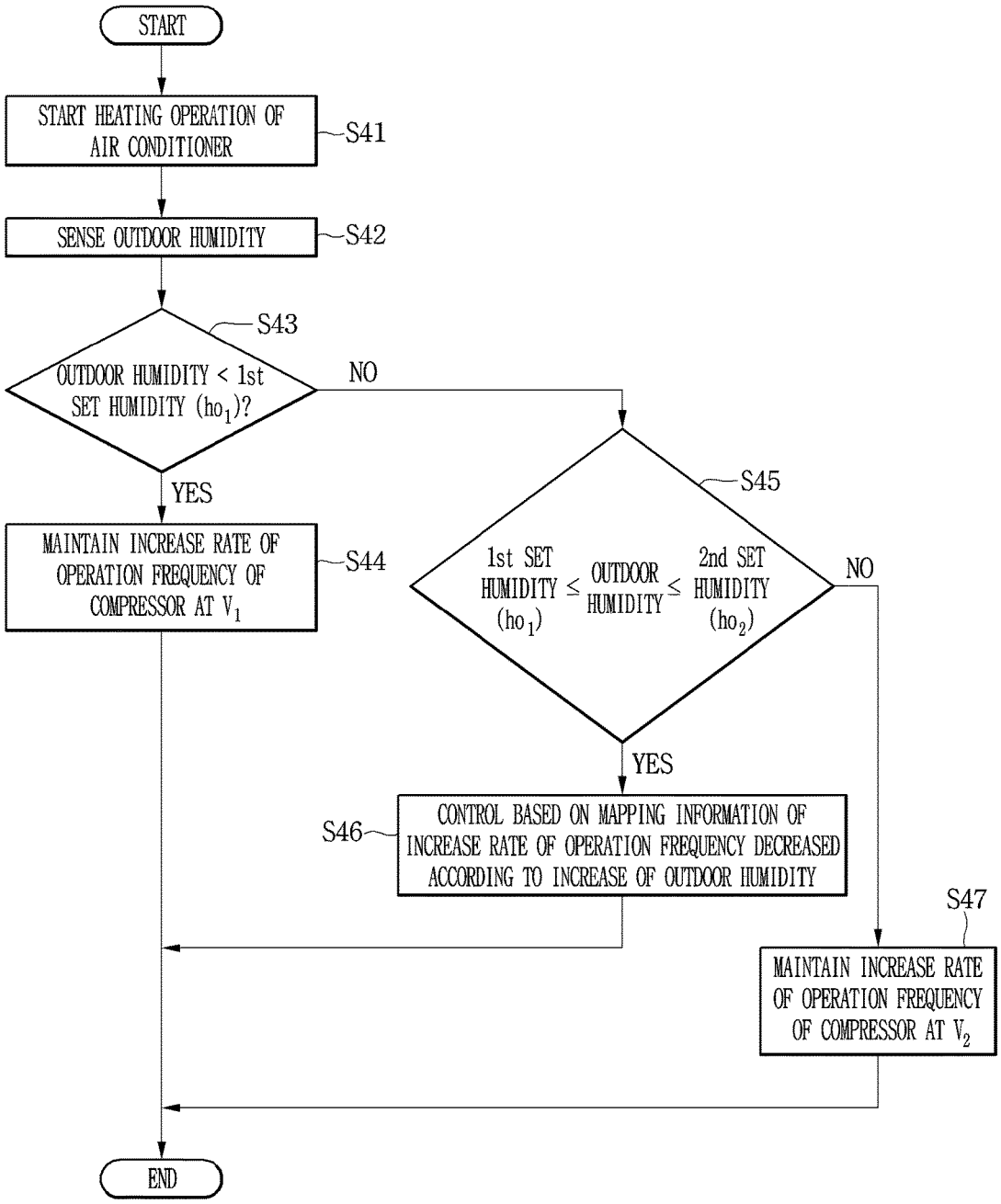
FIG. 9 is a flowchart illustrating a method of controlling the increase rates of the operation frequency of the compressor according to the outdoor humidity, according to the embodiment of FIG. 2.

FIG. 8 is a graph showing a process of controlling the air conditioner in which an increase rate of an operation frequency of a compressor is decreased according to an increase in outdoor humidity, according to the current embodiment. FIG. 9 is a flowchart illustrating a method of controlling the increase rate of the operation frequency of the compressor according to the outdoor humidity, according to the current embodiment.

According to the current embodiment, when a heating operation starts to activate the compressor 160, the air conditioner 10 may perform "a compressor increase rate control mode".

The compressor increase rate control mode may be understood as a mode in which while a compressor is activated to increase an operation frequency of the compressor, a rate of the increasing of the operation frequency is changed according outdoor humidity.

For example, when a compressor is activated at high outdoor humidity to quickly increase an operation frequency thereof to a set frequency, the low pressure is excessively low to decrease a surface temperature of an evaporator to be equal to or lower than a set temperature, which increases the possibility of the production of condensate water and frosting. Thus, when outdoor humidity is relatively high, an increase rate of the operation frequency of the compressor 160 is decreased to prevent an excessive decrease of the low pressure and prevent or reduce the frosting.

In detail, referring to FIG. 8, when the outdoor humidity is lower than an outdoor humidity of ho1 (a first set outdoor humidity), it is recognized that the outdoor humidity is relatively low. Thus, the increase rate of the operation frequency may be maintained at an increase rate V1 (a first set operation frequency rate) until arriving at a set frequency after the activation of the compressor 160.

When the outdoor humidity is higher than an outdoor humidity of ho2 (a second set outdoor humidity), it is recognized that the outdoor humidity is relatively high. Thus, the increase rate of the operation frequency may be maintained at an increase rate V2 (a second set operation frequency rate) until arriving at a set frequency after the activation of the compressor 160. The outdoor humidity of ho2 may be higher than the outdoor humidity of ho1, and the increase rate V1 may be higher than the increase rate V2.

When the outdoor humidity is equal to or higher than the outdoor humidity of ho1 and is equal to or lower than the outdoor humidity of ho2, an operation of the compressor 160 may be controlled based on information about the increase rate of the operation frequency decreased according to an increase of the outdoor humidity. That is, the memory part 130 stores information mapped such that the increase rate of the operation frequency is decreased according to the increase of the outdoor humidity, and the main control part 150 may control the operation frequency of the compressor 160.

Referring to FIG. 9, when the heating operation of the air conditioner 10 starts, the outdoor humidity may be sensed using the outdoor humidity sensor 120 (operations S41 and S42).

When the outdoor humidity is lower than the outdoor humidity of ho1 as a first set humidity, the increase rate of the operation frequency is maintained at the increase rate V1 (a first rate) after the activation of the compressor 160 (operations S43 and S44).

When the outdoor humidity is equal to or higher than the first set humidity ho1 and is equal to or lower than the outdoor humidity of ho2 as a second set humidity, a control operation of the compressor 160 may be controlled based on mapping information of the increase rate of the operation frequency decreased according to the increase of the outdoor humidity. At this point, the increase rate of the operation frequency of the compressor 160 may have a value higher than the increase rate V1 and lower than the increase rate V2 (operations S45 and S46).

When the outdoor humidity is higher than the second set humidity ho2, the increase rate of the operation frequency is maintained at the increase rate V2 (a second rate) after the activation of the compressor 160 (operations S47).

As such, the increase rate of the operation frequency of the compressor 160 is variously mapped and controlled according to the outdoor humidity, thereby preventing or reducing frosting of the evaporator.

The method as illustrated in FIG. 9 can be performed together with "a target high pressure changing control" as described with reference to FIGS. 7 and 8.

Hereinafter, descriptions will be made according to other embodiments. These embodiments are partially different from the previous embodiment of FIG. 6, in terms of configuration of an air conditioner. Thus, different parts between the previous embodiment and the current embodiments will be described principally, and a description of the same parts thereof will be omitted, and like reference numerals denote like elements throughout.

Figure 10:
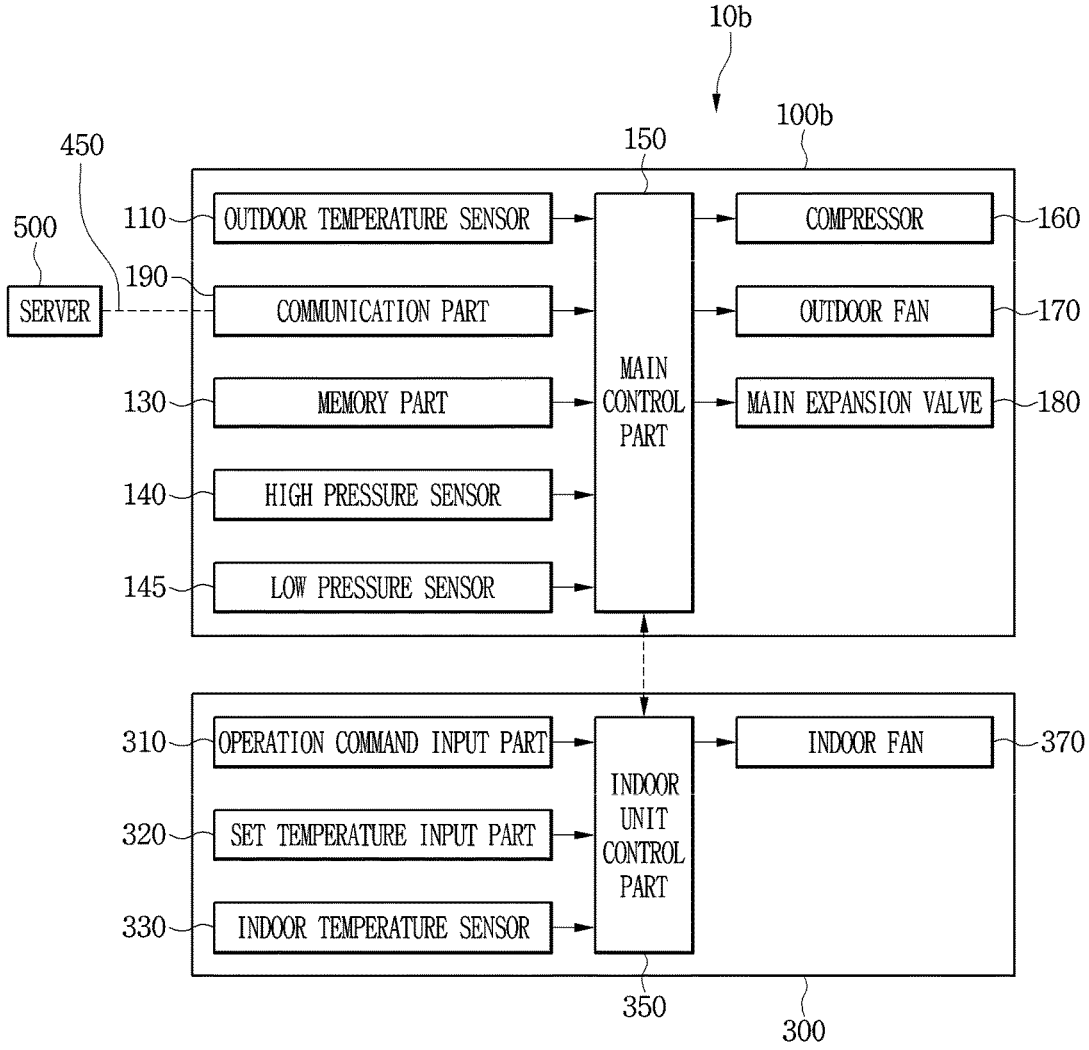
FIG. 10 is a block diagram illustrating a configuration of an air conditioner according to an embodiment of the invention.

FIG. 10 is a block diagram illustrating a configuration of an air conditioner according to one of the current embodiments.

Referring to FIG. 10, an air conditioner 10*b* according to one of the current embodiments includes an outdoor unit 100*b* and an indoor unit 300. The outdoor unit 100*b* includes a communication part 190 that can communicate with a server 500. A communication interface 450 is defined between the server 500 and the communication part 190. For example, the communication interface 450 may include the Internet.

The server 500 has outdoor humidity information. The communication part 190 may receive the outdoor humidity information from the server 500, and the air conditioner 10*b* may be operated according to the control method using outdoor humidity, as described in the previous embodiment of FIG. 6, based on the received outdoor humidity information.

A combination of the communication part 190 according to the current embodiment and the outdoor humidity sensor 120 described in the previous embodiment is called "an outdoor humidity sensing part".

Although the communication part 190 is included in the outdoor unit 100*b* as shown in FIG. 10, the communication part 190 may be included in the indoor unit 300.

The configuration according to the current embodiment makes it possible to obtain outdoor humidity information, without installing a humidity sensor on an outdoor unit.

An air conditioner according to an embodiment can perform a customized heating operation by using information about outdoor temperature and outdoor humidity.

Specifically, when the outdoor humidity is low, dew-point temperature is low. Thus, heating performance can be improved by maintaining a set target high pressure. When the outdoor humidity is high, the dew-point temperature is high. Thus, the possibility of frosting and a frost amount can be decreased by decreasing the set target high pressure and increasing an evaporation temperature (or the low pressure).

In addition, when the outdoor humidity is high, an increase rate of an operation frequency increasing to a target frequency after activation of a compressor is relatively decreased, thereby preventing an excessive decrease of the low pressure caused by an abrupt increase of the operation frequency of the compressor.

In addition, even when a humidity sensor is not installed on an outdoor unit, humidity information may be obtained from an outer server and be used to control the air conditioner, thus reducing the possibility of a trouble caused by the humidity sensor and saving costs.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising:

an outside unit having a compressor and an evaporator;

an outside temperature sensor attached to the outside unit to sense an outside temperature;

an outside humidity sensor to sense an outside humidity;

a low pressure sensor to sense an evaporation pressure of the evaporator; and a controller configured to control operation of the compressor based on the sensed outside temperature, outside humidity, and low pressure by adjusting an operation frequency of the compressor such that:

the operation frequency of the compressor is decreased by a value corresponding to a first predetermined pressure when the evaporation pressure is less than a first reference low pressure, the operation frequency of the compressor is maintained when the evaporation pressure is greater than or equal to the first reference low pressure and is less than or equal to a second reference low pressure, and the operation frequency of the compressor is increased when the evaporation pressure is greater than or equal to the second reference low pressure and is less than or equal to a third reference low pressure;

wherein the controller is further configured such that, in response to the sensed outside humidity increasing from between a first predetermined outside humidity and a second outside humidity to an outside humidity greater than both the first predetermined outside humidity and the second predetermined outside humidity, the controller decreases the rate at which the operation frequency of the compressor is increased.

2. The air conditioner of claim 1, further comprising:

a memory to store mapping information for changing the operation frequency of the compressor according to temperatures sensed by the outside temperature sensor, the value of the humidity sensed by the outside humidity sensor, and the evaporation pressure of the evaporator sensed by the low pressure sensor.

3. The air conditioner of claim 2, wherein the memory stores the value of the third reference low pressure used to determine whether to start or stop a changing mode for the operation frequency of the compressor.

4. The air conditioner of claim 3, wherein the memory further stores the value of the first reference low pressure used to determine whether to decrease the operation frequency of the compressor in the changing mode for the operation frequency of the compressor.

5. The air conditioner of claim 4, wherein the memory further stores the value of the second reference low pressure used to determine whether to increase the operation frequency of the compressor in the changing mode for the operation frequency of the compressor.

6. The air conditioner of claim 2, wherein the memory stores information obtained by mapping values of the increase rate of the operation frequency of the compressor according to the outside humidity.

7. The air conditioner of claim 6, wherein the controller is further configured to:

in response to the outside humidity being less than the first predetermined outside humidity, use a predetermined rate of increase to increase the operation frequency of the compressor until the operation frequency of the compressor reaches a predetermined frequency;

in response to the outside humidity being greater than the second predetermined outside humidity, use a predetermined rate of increase to increase the operation frequency of the compressor until the operation frequency of the compressor reaches the predetermined operation frequency;

wherein the second predetermined outside humidity is greater than the first predetermined outside humidity, and the first predetermined rate of increase is greater than the second predetermined rate of increase.

8. The air conditioner of claim 7, wherein the controller is further configured to, in response to the outside humidity being greater than or equal to the first predetermined outside humidity and less than or equal to the second predetermined outside humidity, reduce the rate at which the operation frequency is increased.

9. The air conditioner of claim 3, wherein when the evaporation pressure is greater than or equal to the third reference low pressure, the controller stops the changing mode for the operation frequency of the compressor.

10. The air conditioner of claim 1, wherein the outside humidity sensor is attached to the outside unit.

* * * * *